US010179259B1

(12) United States Patent
Zagata

(10) Patent No.: US 10,179,259 B1
(45) Date of Patent: Jan. 15, 2019

(54) EXERCISE WEIGHT AND SET OF EXERCISE WEIGHTS

(71) Applicant: Zachary Zagata, Sayreville, NJ (US)

(72) Inventor: Zachary Zagata, Sayreville, NJ (US)

( * ) Notice: Subject to any disclaimer, the term of this patent is extended or adjusted under 35 U.S.C. 154(b) by 117 days.

(21) Appl. No.: 15/162,720

(22) Filed: May 24, 2016

(51) Int. Cl.
*A63B 21/072* (2006.01)
*A63B 21/00* (2006.01)
*A63B 23/12* (2006.01)

(52) U.S. Cl.
CPC ..... *A63B 21/072* (2013.01); *A63B 21/0004* (2013.01); *A63B 21/4035* (2015.10); *A63B 23/12* (2013.01)

(58) Field of Classification Search
CPC ..... A63B 21/072; A63B 21/0724
See application file for complete search history.

(56) References Cited

U.S. PATENT DOCUMENTS 4,995,604 A 2/1991 Lynch et al.
D370,951 S * 6/1996 Lazar ..... D21/692
5,674,162 A 10/1997 Ellingson et al.
6,053,846 A * 4/2000 Lin ..... A63B 21/22 482/110
6,068,580 A 5/2000 Myers et al.
6,190,292 B1 2/2001 Panes
7,094,186 B2 8/2006 Diakonov et al.
8,454,483 B1 6/2013 Bradley et al.
8,608,628 B2 12/2013 Mathews
8,911,334 B1 12/2014 Cotter et al.
2006/0172872 A1 8/2006 Nasir
2013/0012367 A1 1/2013 Williams
2014/0256522 A1 9/2014 Holt, IV et al.
2014/0287891 A1 9/2014 Marich et al.

* cited by examiner

*Primary Examiner* — Loan H Thanh
*Assistant Examiner* — Rae Fischer
(74) *Attorney, Agent, or Firm* — Thomas L. Adams

(57) ABSTRACT

A pair of handle members are attached to opposite sides of a weight member that is convexly rounded over most of its surface. Each of the handle members has at least three handholds with different spatial relationships. The handle members each have an outer section with a core of solid material spaced from the weight member. The handle members have a plurality of connecting sections with at least four of them connected to the weight member. Opposite ends of the outer section are separately supported by a corresponding pair of the connecting sections. The weight member has clearance to allow passage of an exerciser's body part through a common transverse plane that engages the handles, if the passage is outside a region between the pair of handles. These weights can be assembled in different sizes. The weights of this set each have one or more flat sections arranged to allow vertical stacking.

18 Claims, 10 Drawing Sheets

EXERCISE WEIGHT AND SET OF EXERCISE WEIGHTS

BACKGROUND OF THE INVENTION

1. Field of the Invention

The present invention relates to exercise equipment, and in particular, to free weights that can be manually lifted by handles.

2. Description of Related Art

Known kettle bells are available in the form of a spherical weight cast with a single handle on one side. When lifting this kettle bell the spherical weight will be suspended like a pendulum below the handle. For certain exercises the spherical weight will tend to strike or press against parts of the exerciser's body, interfering with the exercise. For example, in a standing overhead press, the weight will press against the forearm and apply an undesirable torque on the wrist.

Some exercises are performed by swinging the kettle bell. For example, an exerciser can swing the kettle bell from a position near the right foot, diagonally across the body to an overhead position on the left. If an exerciser swings the kettle bell too vigorously, the spherical weight will tend to swing outwardly briefly before returning to a stable position. This periodic swinging of the spherical weight can produce excessive torque at the handle and can cause a dangerous impact when the weight returns to a stable position. Moreover, depending upon the arc of the swinging exercise, the spherical weight can produce a torque about an axis transverse to the handle.

Also, some exercises ought not to be done with a kettle bell. In a hammer curl, an exerciser will hold the weight's handle vertically and lift the weight by articulating the forearm about the elbow, while keeping the upper arm vertical. This maneuver will apply excessive torque to the wrist.

See also U.S. Pat. Nos. 4,995,604; 5,674,162; 6,068,580; 6,190,292; 7,094,186; 8,454,483; 8,608,628; and 8,911,334, as well as U.S. Patent Application Publication Nos. 2006/0172872; 2013/0012367; 2014/0256522; and 2014/0287891.

SUMMARY OF THE INVENTION

In accordance with the illustrative embodiments demonstrating features and advantages of the present invention, there is provided an exercise weight that has a weight member and an opposite pair of handle members attached to the weight member. The weight member is convexly shaped over most of its surface. The pair of handle members engage a common transverse plane. Each of the pair of handle members has at least three handholds that have a different spatial relationship to one another. The pair of handle members each have an outer section with a core of solid material spaced from the weight member. The pair of handle members include a plurality of connecting sections with at least four of them connected to the weight member. The outer section has a pair of opposite ends. The pair of opposite ends are separately supported by a corresponding pair of the plurality of connecting sections. The weight member has clearance to allow passage of an exerciser's body part through the common transverse plane if outside a region between the pair of handles.

In accordance with another aspect of the invention, there is provided an exercise set that includes a plurality of differently sized weights. The plurality of weights each have one or more flat sections arranged to allow vertical stacking. Each of the weights includes a weight member, and an opposite pair of handle members attached to the weight member. The weight member is convexly shaped over most of its surface. The pair of handle members engage a common transverse plane. Each of the pair of handle members has at least three handholds that have a different spatial relationship to one another. The pair of handle members include an outer section and a plurality of connecting sections with at least four of them connected to the weight member. The outer section has a pair of opposite ends. The pair of opposite ends are separately supported by a corresponding pair of the plurality of connecting sections.

In accordance with yet another aspect of the invention, there is provided an exercise weight. The exercise weight includes a weight member and an opposite pair of handle members attached to the weight member. The weight member is convexly rounded over most of its surface. The pair of handle members occupy a common transverse plane. Each of the pair of handle members has at least three handholds that have a different spatial relationship to one another. The pair of handle members each have an outer section with a core of solid material spaced from the weight member. The pair of handle members include a plurality of connecting sections with at least four of them connected to the weight member. The outer section has a pair of opposite ends. The pair of opposite ends are separately supported by a corresponding pair of the plurality of connecting sections. The weight member has clearance to allow passage of an exerciser's body part through the common transverse plane, if outside a region between the pair of handles. The outer section is at least twice as long as the corresponding pair of the plurality of connecting sections. The outer section is a double handed grip and the corresponding pair of the plurality of connecting sections are single handed grips. The exercise weight, excluding portions occupied by the pair of handle members, is symmetrical or nearly symmetrical about an axis perpendicular to the transverse plane. The exercise weight is symmetrical or nearly symmetrical about the transverse plane. The weight member has on opposite sides a pair of flat sections that are both parallel to the transverse plane. The at least four of the plurality of connecting sections that connect to the weight member connect at locations on the weight member that are equiangularly spaced. At least two of the plurality of connecting sections that connect to the weight member connect at locations on the weight member that are diametrically opposed. The at least four of the plurality of connecting sections that connect to the weight member have a straight centerline. The at least four of the plurality of connecting sections that connect to the weight member connect at a right pair and a left pair of locations on the weight member. The right pair of locations are associated with one of the pair of handle members. The other one of the pair of handle members is associated with the left pair of locations. Each of the right pair of locations are spaced from each of the left pair of locations by at least 90°. The plurality of connecting sections at the right pair of locations extend acutely from one another. The plurality of connecting sections at the left pair of locations extend acutely from one another. Each of the plurality of connecting sections at the right pair of locations are parallel to a different corresponding one of the plurality of connecting sections at the left pair of locations. The at least four of the plurality of connecting sections that connect to the weight member are at most half as long as the outer section of either of the pair of handle members. The outer section has an arcuate centerline.

By employing equipment of the foregoing type, an improved exercise weight is achieved. In a disclosed embodiment a central weight has a mostly spherical shape with one or two flat sections at opposite poles of the central weight. A pair of handles extend from opposite sides of the central weight in a transverse plane (equatorial plane) parallel to the flat section(s). Each of the handles has a pair of spokes (connecting sections) that extend from the central weight to opposite ends of a curved outer section. The proximal ends of the spokes of the two handles are angularly spaced approximately 90°, although other spacings are contemplated.

The handles can be gripped in a variety of ways. For example, one or two hands can grip the outer section of one handle. Alternatively, the outer sections of both handles can be separately gripped by the right and left hands. In some cases the exerciser can grip both spokes of a handle. In other cases the exerciser can grip one spoke from each of the two handles, gripping either spokes that are adjacent or opposite. The foregoing can be overhand or underhand grips, or a combination of both. Using the various gripping patterns, an exerciser can perform a variety of lifting exercises The foregoing exercise weight can be placed on the floor with its flat section down. Then an exerciser can hold the outer sections of the two handles and perform a push-up.

Exercise weights of this type can be provided as a set of weights, each weighing a different amount. When no longer in use, this set of weights can be stacked with their flat sections lying face to face.

In another embodiment, two U-shaped handles can be connected together at a pair of annular junctures. A central weight can be releasably secured to the pair of handles by passing a pin through one annular juncture, into an axial through-hole in the central weight, and finally through the opposite annular juncture. A disclosed removable pin has a pair of retractable balls at one end, and at the opposite end a collar with a pushbutton that can be operated to retract the balls. The retractable balls will be inserted to the outside of one of the annular junctures to prevent pin removal until the balls are retracted by operating the pushbutton.

In this embodiment, the integrated handle structure can hold any one of a number of differently sized central weights. Accordingly, the removable pin can be temporarily removed and the central weight replaced with another so the exerciser can choose the desired resistance.

In another embodiment a removable ball bearing mounted on one side of the weight can be placed on the floor while the exerciser grasps the weight by its handles. This arrangement is challenging since the weight can move as the ball rolls along the floor.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION

Figure 1:
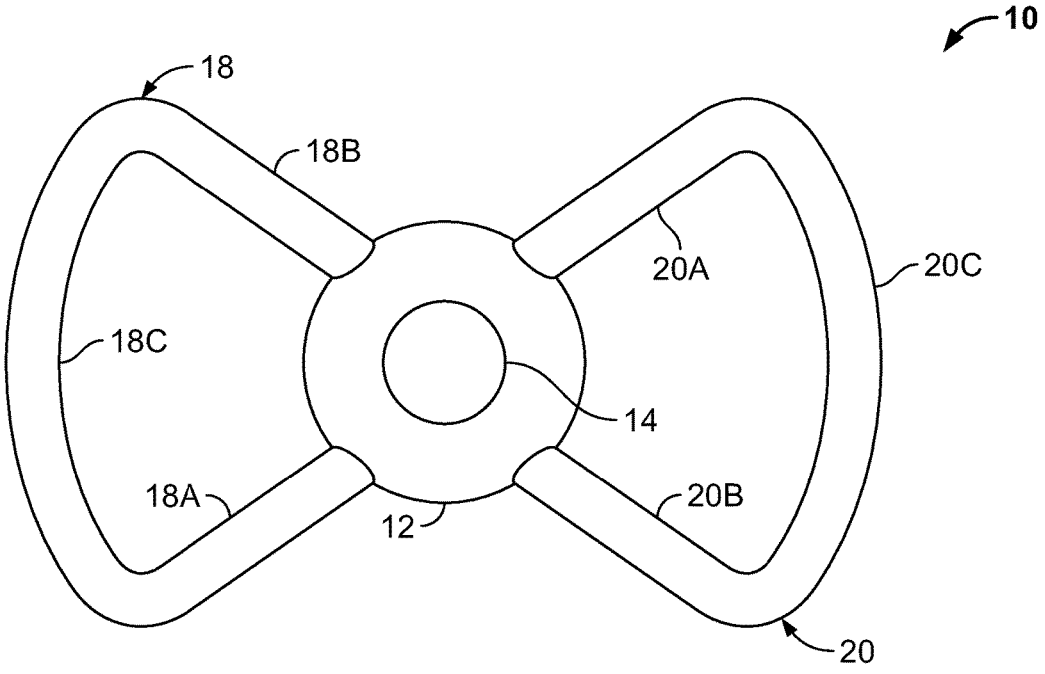
FIG. 1 is front view of an exercise weight in accordance with principles of the present invention.
Figure 2:
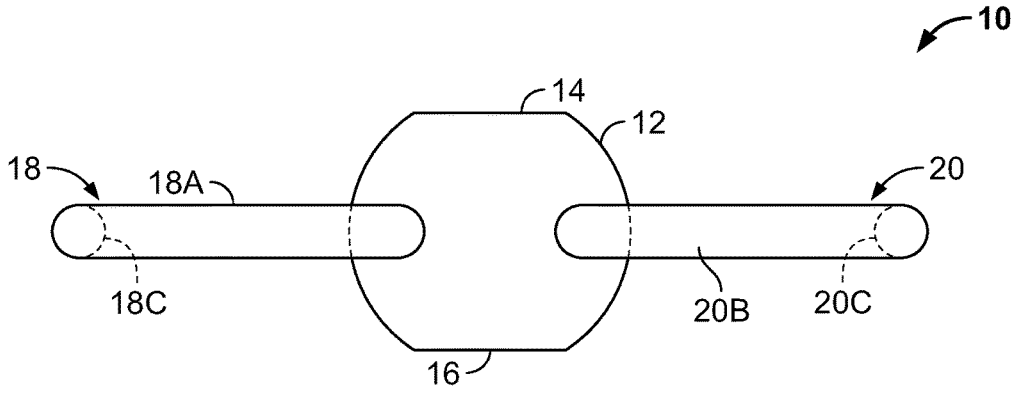
FIG. 2 side view of the exercise weight of FIG. 1.

Referring to FIGS. 1 and 2, an exercise weight 10 is shown as a weight member 12 that is connected on opposite sides to pair of handle members 18 and 20. Weight member 12 is mostly spherical except for flat sections 14 and 16 at polar opposite locations. On the other hand, member 12 need not be spherical and may have other shapes such as ovoid, teardrop shape, cubic, polyhedral, annular, etc (A polyhedral shape will be considered convex, but not rounded, in regions where none of the flat surfaces are folded inwardly.) Weight member 12 will be compact and efficiently use space if it is convexly shaped or convexly rounded over most of its surface.

Handle number 18 (20) has a pair of connecting sections 18A and 18B (20A and 20B) that connect between weight member 12 and the opposite ends of outer section 18C (20C). Outer section 18C (20C) has an arcuate centerline and is designed as a double-handed grip. Connecting sections 18A and 18B (20A and 20B) are single-handed grips with a straight centerline. Sections 18A, 18B, and 18C (20A, 20B, and 20C) are also referred to as a trio of handholds. Outer section 18C (20C) is at least twice as long as its supporting, corresponding pair of connecting sections 18A and 18B (20A and 20B).

The four connecting sections 18A, 18B, 20A, and 20B connect to weight member 12 at four locations that are approximately equiangularly spaced. Accordingly, the connecting locations (proximal ends) of sections 18A and 20A are placed at approximately two diametrically opposed locations. The same can be said for the connecting locations of sections 18B and 20B.

The connecting locations (proximal ends) of sections 18A and 18B may be considered a left pair of locations, while the connecting locations (proximal ends) of sections 20A and 20B may be considered a right pair of locations (although right and left are somewhat arbitrary and can be reversed depending on one's vantage point). Good results can be achieved if the proximal ends of sections 18A and 18B are angularly spaced at least 90° from the proximal ends of sections 20A and 20B.

The centerlines of connecting sections 18A and 18B (as well as the center lines of sections 20A and 20B) extend at an acute angle (approximately 76° in this embodiment, although other angles including oblique angles may be used in different embodiments). Connecting sections 18A, 18B, 20A, and 20B are arranged so that sections 18A and 20A are parallel, and sections 18B and 20B are parallel, as well.

The centerlines of sections 18A, 18B, 20A, and 20B all engage (and occupy) a common transverse plane and exercise weight 10 is symmetrical about this transverse plane. Moreover, weight member 12 is symmetrical about a polar axis that is perpendicular to this common transverse plane and that passes through the center of the weight member 12, provided one excludes from consideration the portions of weight member 12 that are partially invaded by handle members 18 and 20. It will be noticed that flat sections 14 and 16 are parallel to this transverse plane.

In this embodiment exercise weight 10 is a single casting of iron or other metal. Accordingly, handles 18 and 20 will have a core of solid material, as will weight member 12. In other embodiments exercise weight 10 may be a hollow plastic casing that is filled with granular material such as sand.

Because weight member 12 is relatively compact, body parts of the exerciser can pass in close proximity to weight member 12. Therefore, an exerciser can lift and swing exercise weight 10 with little likelihood of impact with weight member 12. Good results are achieved if there is clearance for passage of a body part through the above-mentioned transverse plane, with the possible exception of regions between the handle members 18 and 20. It will be noticed that the present embodiment has more clearance than that, because there is actually clearance throughout most of the region between connecting sections 18A and 20B (as well as sections 18B and 20A).

In this embodiment weight member 12 has a 5 inch (12.7 cm) diameter and sections 18A and 20B (as well as sections 18B and 20A) diverge at an angle of about 104°. The overall length of weight 10 is 15½ inch (39.4 cm from the outside of section 18C to the outside of section 20C), and the overall width is 9 15/16 inch (25 cm). Each section of handles 18 and 20 has a circular cross-section throughout, with a 1 inch (2.5 cm) diameter. The outer sections 18C and 20C both follow a circular arc about the center of weight member 12. The diameter of flat sections 14 and 16 are each 2¼ inch (5.7 cm). It will be appreciated that all of the foregoing dimensions can be altered depending upon the expected exercises, desired weight, available storage space, desired product strength, etc.

Figure 3:
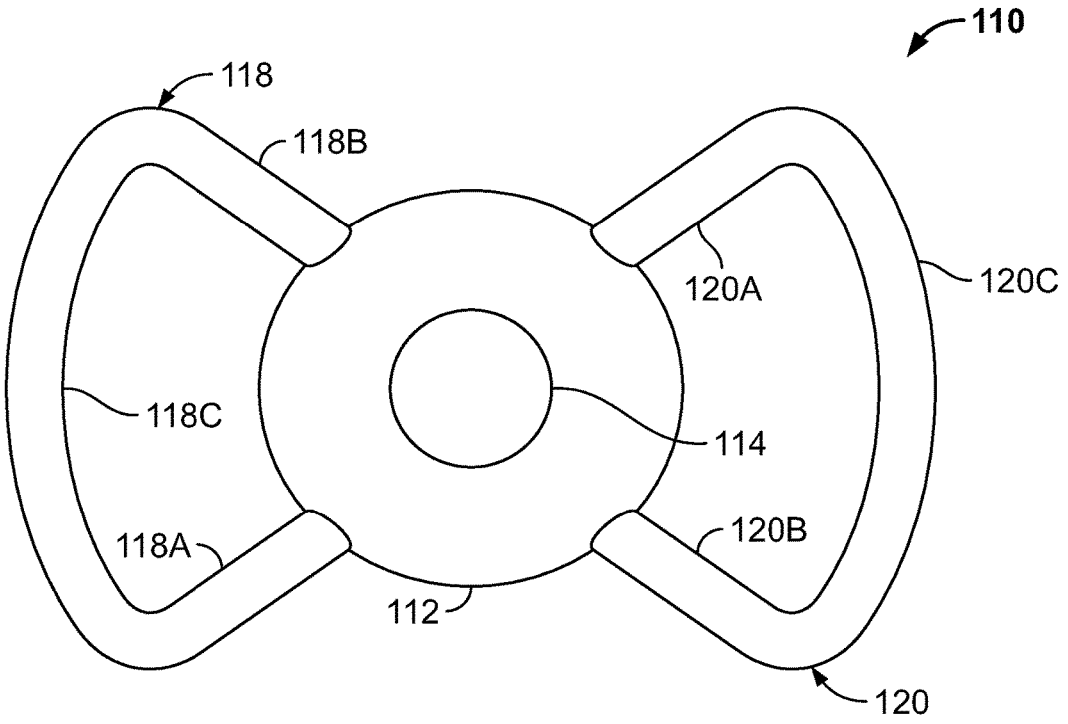
FIG. 3 is front view of an exercise weight that is an alternate to that of FIG. 1.
Figure 4:
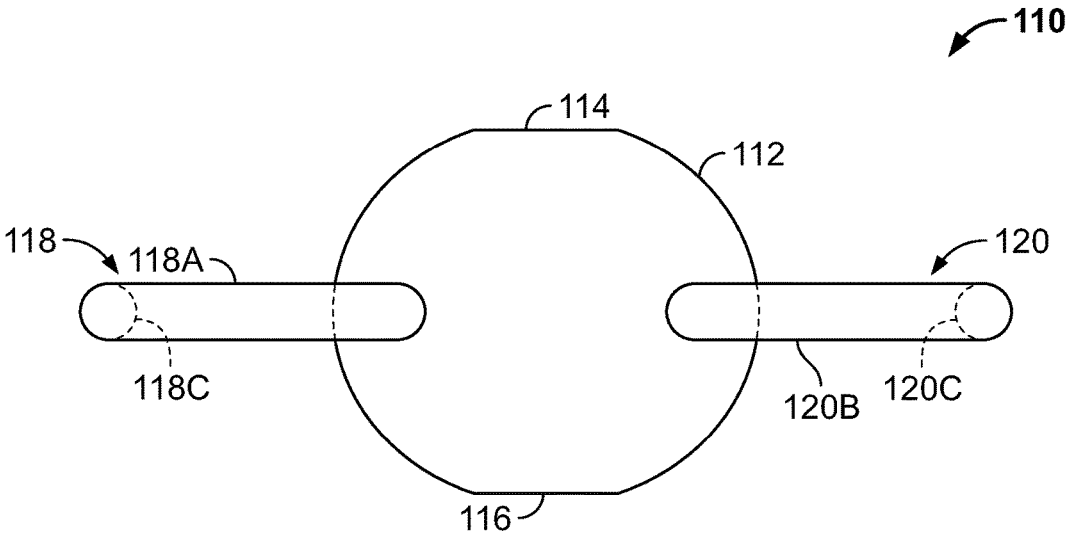
FIG. 4 side view of the exercise weight of FIG. 3.

Referring to FIGS. 3 and 4, weight 110 has been scaled up to make it heavier. Components corresponding to those previously illustrated in FIGS. 1 and 2 bear the same reference numerals but increased by 100.

The overall dimensions of weight 110 remain the same, that is, its overall length is 15½ inch (39.4 cm from the outside of section 118C to the outside of section 120C), and the overall width is 9 15/16 inch (25 cm). However, the diameter of weight member 112 was increased to 7 inches (17.8 cm), which causes a corresponding reduction in the length of connecting sections 118A, 118B, 120A, and 120B. The diameters of flat sections 114 and 116 were increased to 2½ inches (6.4 centimeters). Handles 118 and 120 retain the same circular cross-section with a 1 inch (2.5 cm) diameter. Connecting sections 118A, 118B, 120A, and 120B have the same angular orientation as before. Also, outer sections 118C and 120C have the same curvature as before.

Figure 5:
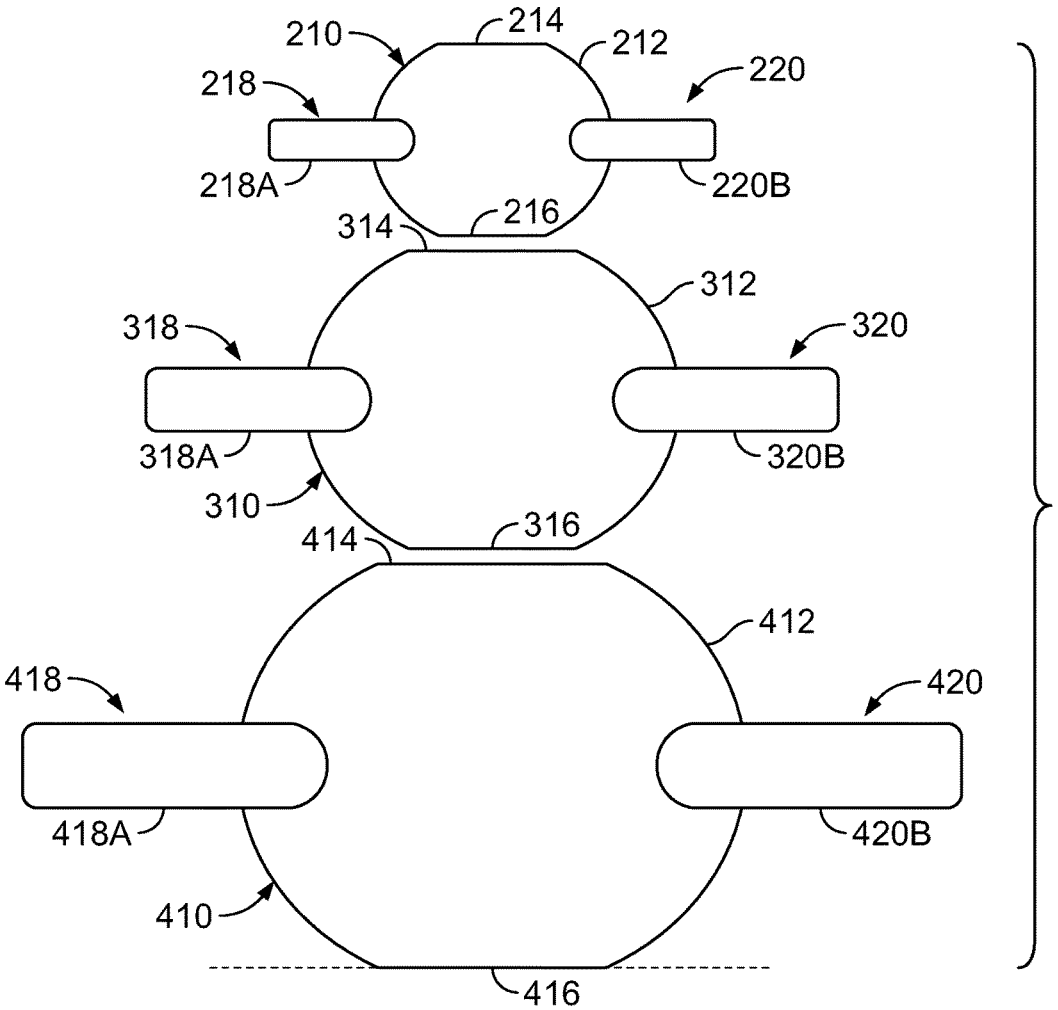
FIG. 5 is a side view of a stacked set of exercise weights that are alternatives to those of FIGS. 1-4.

Referring to FIG. 5, the illustrated exercise set includes a trio of differently sized weights 210, 310, and 410. Weight 210 is typical in that it has rounded weight member 212 with flat circular sections 214 and 216 at polar opposite locations. Weight 210 also has an opposing pair of handles 218 and 220 located in a common, transverse, equatorial plane. As before, handles 218 and 220 will each have an outer handle section connected at opposite ends through connecting sections to weight member 210.

Weight 312 member is larger and heavier than weight member 212, and is basically a scaled up version of weight member 212. Components of weight 310 corresponding to components of weight 210 have the same reference numerals but increased by 100. Weight 410 is scaled up further and is the largest and heaviest of the three. Components of weight 410 corresponding to components of weight 210 have the same reference numerals but increased by 200.

Weights 210, 310, and 41 are shown vertically stacked. Flat section 416 of weight member 412 will rest on a horizontal surface such as a floor. Flat section 316 of weight member 312 will be placed atop flat section 414 of weight member 412. Also, flat section 216 will be placed atop flat section 314 of weight member 312. Any of the weights 210, 310, and 410 can be flipped and still stacked, since they are symmetrical about the transverse, equatorial plane containing their handles (i.e., handles 218, 220, 318, 320, 418, and 420).

If this specific symmetry is unimportant, or if one must be certain of that weight 212 is on top, weight 212 can be made with only one flat section. For example, flat section 214 can be rounded so that no other weight can be stably placed above it.

To facilitate an understanding of the principles associated with the foregoing apparatus, the use of weight 10 (FIGS. 1 and 2) will be briefly described in connection with gripping diagrams of FIGS. 6-11.

Figure 6:
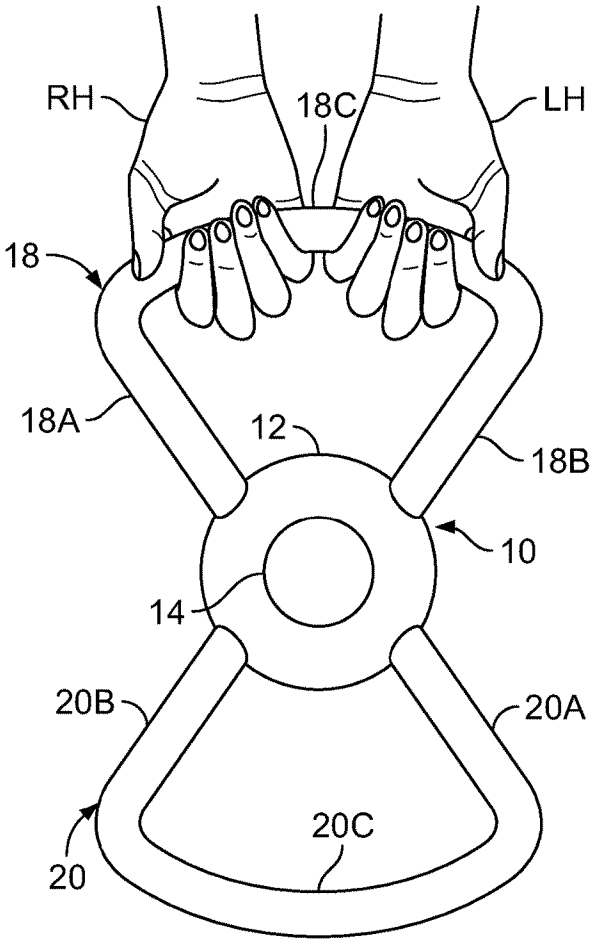
FIG. 6 is a front view of the exercise weight of FIG. 1 showing a method of holding the weight.

In FIG. 6, right hand RH and left hand LH both hold outer handle section 18C with an underhand grip (and thumbs to the outside). In some cases handle section 18C can be held with an overhand grip. Also, handle section 20C can be used equally as well, because weight 10 is symmetrical about a plane that is perpendicular to flat section 14 and equidistant between handles 18 and 20.

Figure 7:
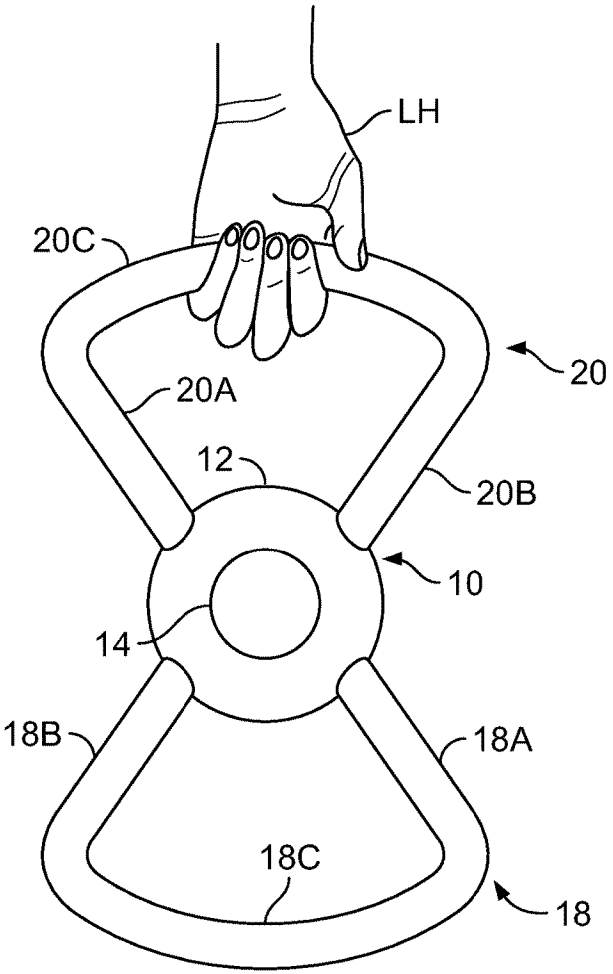
FIG. 7 is a front view of the exercise weight of FIG. 1 showing another method of holding the weight.

In FIG. 7 left hand LH holds outer handle section 20C with an underhand grip by itself. It will be understood that an overhand grip may be employed and that outer handle section 18C may be held instead to achieve the same effect. Also, left hand LH can be replaced with a right hand.

Figure 8:
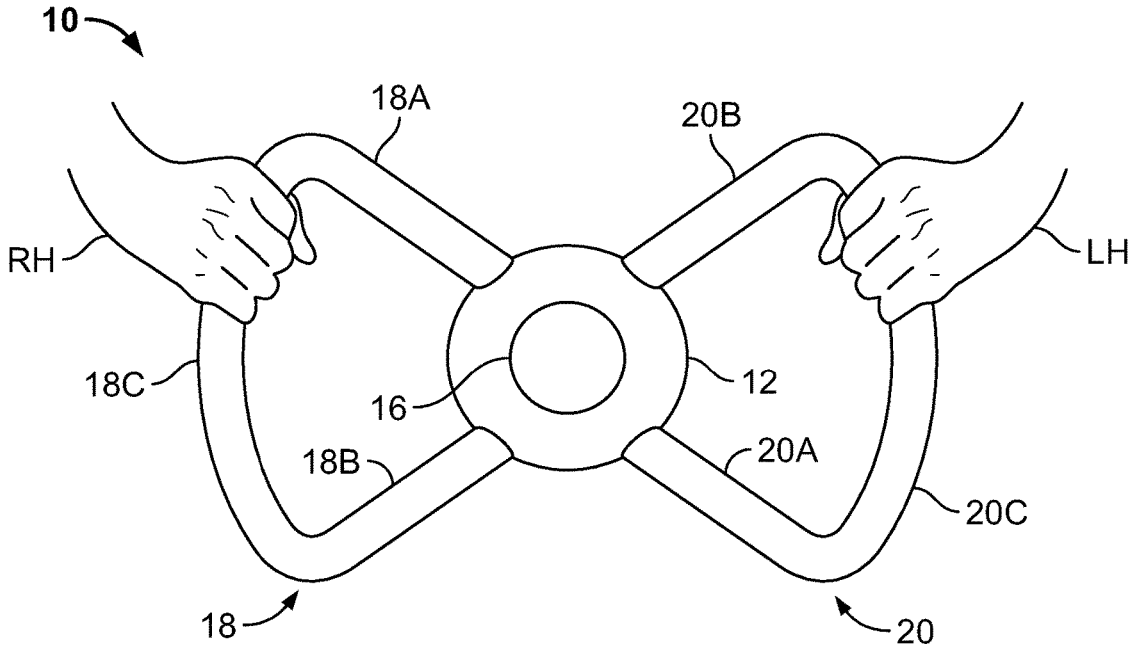
FIG. 8 is a front view of the exercise weight of FIG. 1 showing another method of holding the weight.

In FIG. 8 right hand RH and left hand LH hold outer handle sections 18C and 20C, respectively, in a hammer grip. While these grips are high on outer handle sections 18C and 20C, the grip can be lowered in other cases. Also, weight 10 can be axially rotated 180° about a central axis perpendicular to flat section 16 to reverse the roles of outer handle sections 18C and 20C.

Figure 9:
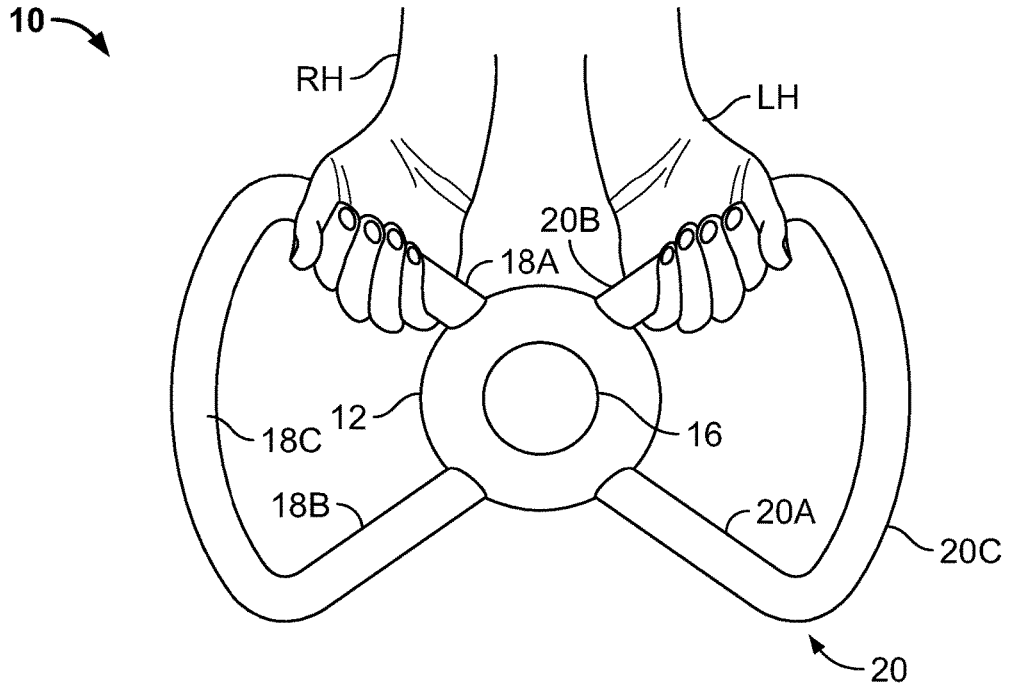
FIG. 9 is a front view of the exercise weight of FIG. 1 showing another method of holding the weight.

In FIG. 9, right hand RH and left hand LH hold connecting section 18A and 20B with an underhand grip (and thumbs to the outside). An overhand grip would be uncomfortable at the illustrated angles, but an overhand grip would be convenient along lower connecting sections 18B and 20A. The latter grip is a top heavy arrangement, but this may beneficially require more effort in the gripping fingers and in the supporting wrists. Again, weight 10 can be axially rotated 180° to interchange handle 18A (20B) with handle 20A (18B).

Figure 10:
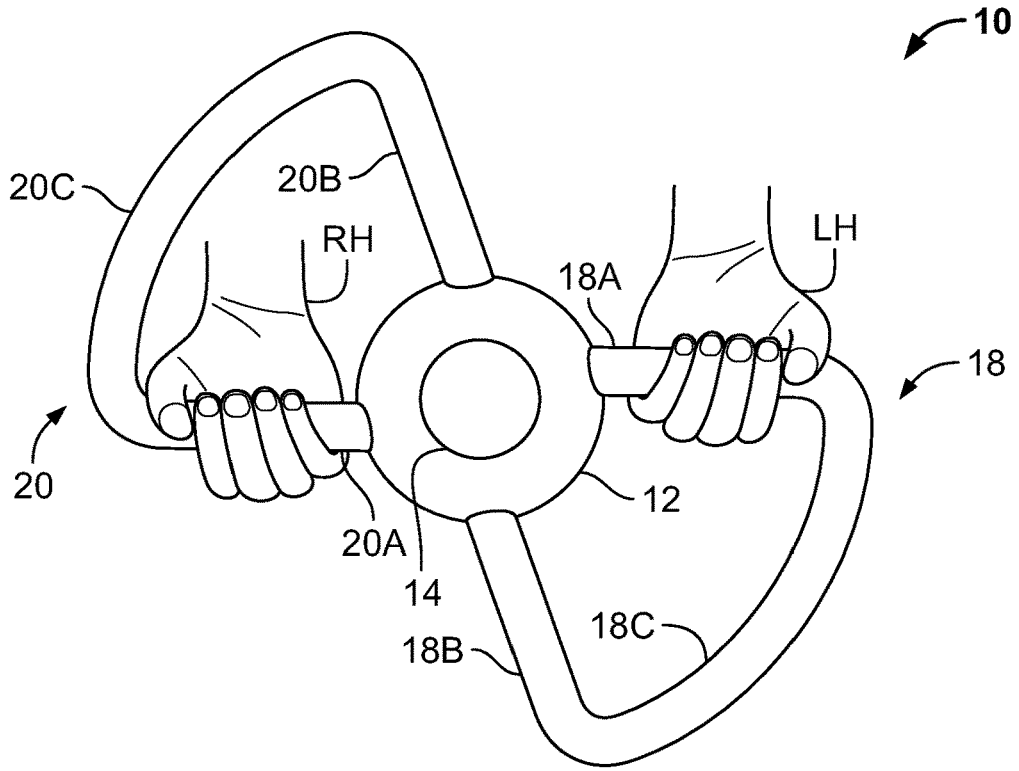
FIG. 10 is a front view of the exercise weight of FIG. 1 showing another method of holding the weight.

In FIG. 10, right hand RH and left hand LH hold connecting sections 20A and 18A, respectively, with an underhand grip (and thumbs to the outside). In some cases section 20A and 18A can be held with an overhand grip. Also, handle section 20B and 18B can be used equally as well, and weight 10 will have the same balance or feel.

Figure 11:
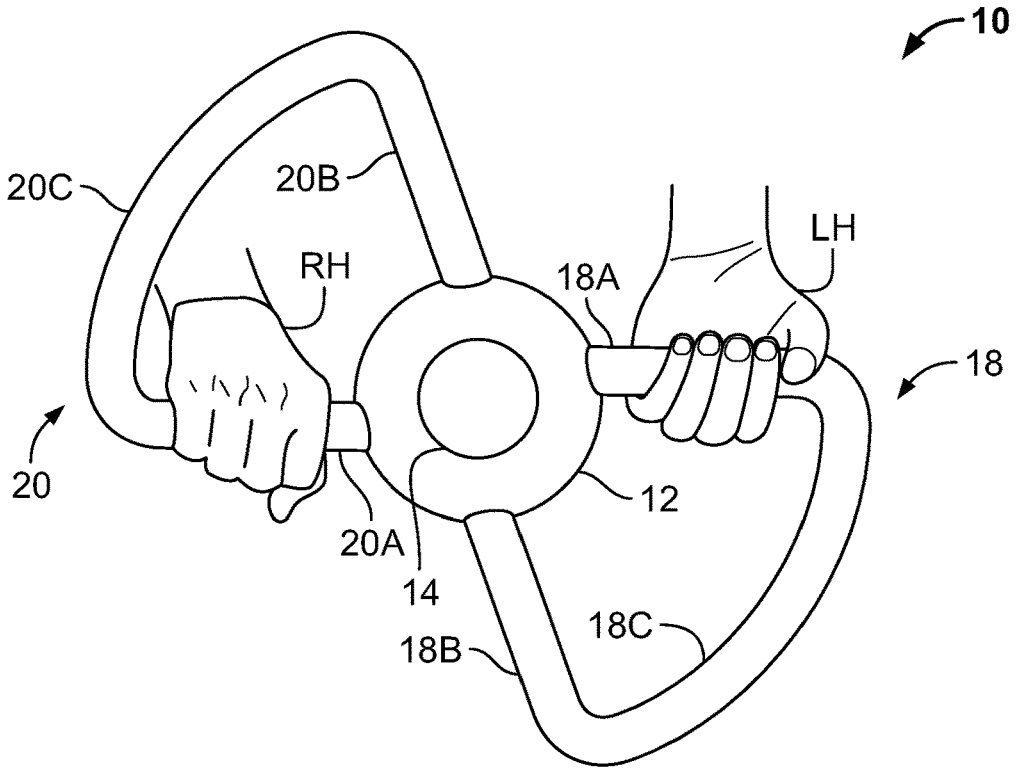
FIG. 11 is a front view of the exercise weight of FIG. 1 showing another method of holding the weight.

In FIG. 11 left hand LH holds section 18A in an underhand grip as before. Now however, right hand RH holds section 20A in an overhand grip. It will be appreciated that the gripping can be reversed, that is, an underhand grip on the right and an overhand grip on the left. Also, handle sections 20B and 18B can be used equally as well, and weight 10 will have the same balance or feel.

The foregoing grips can be used in a variety of exercises. For example, bicep curls can be conveniently performed using the gripping patterns shown in FIGS. 6, 7, 9, and 10. Hammer curls can be done with the grip shown in FIG. 8.

Tricep exercises can be performed while standing erect, keeping the weight 10 behind the head with the elbows up, and lifting the weight with two hands placed as shown in FIG. 8 or 9 (or single-handed kickbacks can be performed with the upper arm horizontal and the torso bent forward). Lying supine on a bench, pointing the elbows away (distally), and keeping the upper arms horizontal one can use two hands to lift weight 10 by extending the forearms at the elbow (same exercise can be performed with one hand).

Standing erect and using the single-handed grip of FIG. 7, one can exercise a shoulder by lifting the arm laterally or frontally. Using the two hand grip of FIG. 8, one can stand erect and lift weight 10 directly overhead (shoulder press). The shoulder press can alternate with a squat performed while holding weight 10 at chest height. Using a one or two hand grip, one can swing weight 10 diagonally across the front of the body from a lower left (right) position to an upper right (left) position, and back again.

Using a one or two hand grip (e.g., FIGS. 7-10) and bending at the waist, one can pull weight 10 upwardly to perform a rowing exercise. Lying supine on a bench, one can use two hands (e.g., FIGS. 8-10) to lift weight 10 vertically (bench press). Holding weight 10 with two hands (e.g., FIGS. 8-10) while lying supine, and keeping the arms straight, one can swing the arms 180°. Weight 10 can be used with a single handed grip like an ordinary dumbbell to perform flyes, or reverse flyes. Using two hands and keeping weight 10 near the chest will increase the challenge of performing a sit up, or back extension (waist bend).

Flat section 14 of weight 10 can be laid on the floor as the exerciser then grips the middle of outer handle sections 18C and 20C. The exerciser can then perform a push up with the flat section 14 stabilizing the weight 10. From a push up position, one can also perform a "mountain climber" or a "burpee" (burpee can be performed without letting go of weight 10).

It will be appreciated that any of the foregoing exercises can be performed just as well with weights 110, 210, 310, or 410. The weight chosen will depend upon the strength of the exerciser and the desired intensity of the workout.

Figure 12:
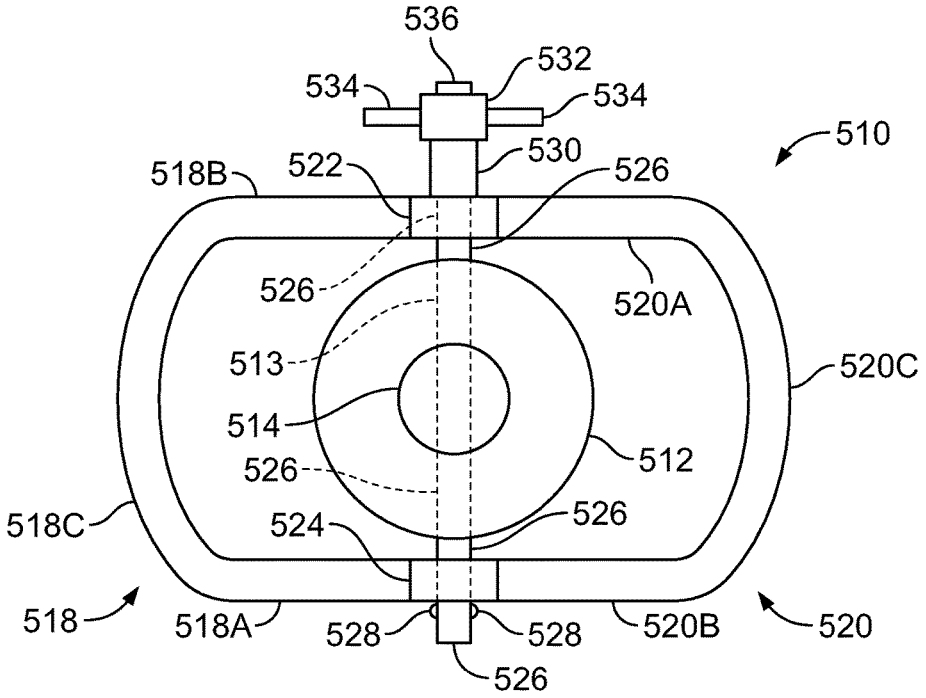
FIG. 12 is a front view of an exercise weight that is an alternate to that of FIGS. 1-5.
Figure 13:
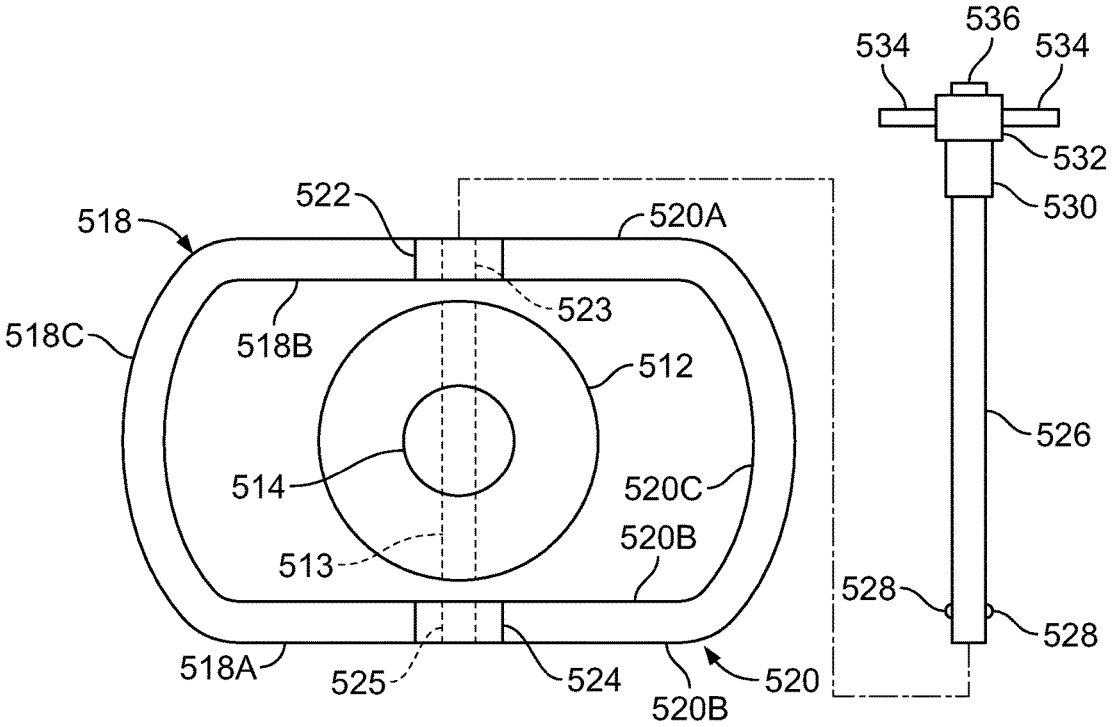
FIG. 13 side view of the exercise weight of FIG. 12, shown disassembled.

Referring to FIGS. 12 and 13, alternate weight 510 has a weight member 512 that is mostly spherical, excluding circular flat section 514 and on the opposite side another circular flat section (not shown). Weight member 512 has through its center a diametric through hole 513 parallel to flat section 514. Handle 518 (520) has a curved outer section 518C (520C) supported on opposite ends by connecting sections 518A and 518B (520A and 520B). The proximal ends of sections 518A and 520B (518B and 520A) integrally connect to interhandle juncture 524 (522). Interhandle junctures 522 and 524 are each an annulus with coaxial through holes 523 and 525, respectively.

In this embodiment connecting sections 518A and 520B are aligned, as are sections 518B and 520A. In particular, the corresponding pair of connecting sections 520A and 520B of handle 520 are aligned one to one with the other corresponding pair of connecting sections 518B and 518A of handle 518.

Outer sections 518C and 520C are essentially coplanar with connecting sections 518A, 518B, 520A, and 520B. The centerlines of outer sections 518C and 520C have a radius of curvature centered at the center of weight member 512 (FIG. 12).

An opposing pair of retractable balls 528 are located on one end of removable pin 526. Coaxially mounted at the other end of removable pin 526 is a larger-diameter collar 530 supporting capstan 532, which has an opposing pair of radial finger pulls 534. Projecting from the distal end of capstan 532 is a pushbutton 536 that can be depressed to allow balls 528 to retract. Pins of this type can be obtained from McMaster-Carr (Robbinsville, N.J.) as a stainless steel, heavy-duty, pushbutton quick-release pin.

Weight 510 can be assembled by depressing pushbutton 536 with a thumb and pulling on pulls 534 with the fingers of the same hand, thereby allowing balls 528 to retract. Thereafter, the ball-end of pin 526 is inserted through the hole 523 of annular juncture 522. Through hole 513 of weight member 512 will be aligned with juncture hole 523 to allow further insertion of pin 526 into through hole 513. Thereafter the ball-end of pin 526 emerges and is inserted into hole 525 of annular juncture 524. Once pin 526 is fully inserted and collar 530 rests against annular juncture 522, pushbutton 536 is released, causing balls 528 to project into the position shown in FIG. 12. Projection of balls 528 will lock pin 526 in place thereby capturing weight member 512.

Handle sections 518A, 518B, 518C, 520A, 520B, and 520C correspond to handle sections 18A, 18B, 18C, 20A, 20B, and 20C of FIG. 1. Accordingly, an exerciser can use the gripping patterns of FIGS. 6-9. The gripping patterns of FIGS. 10 and 11 can be used if desired, although handle sections 520A and 518A will not be aligned but will be stacked. In any event, all the exercises described in connection with weight 10 of FIG. 1 can be performed as well with weight 510 of FIG. 12.

When an exerciser wishes to use a heavier or lighter weight, weight member 512 can be removed and replaced. Specifically, pushbutton 536 is depressed to release balls 528 before withdrawing pin 526 from annular juncture 524, weight member 512, and annular juncture 522. Thereafter a larger or smaller weight member can be installed by aligning its diametric through hole with holes 523 and 525 before reinserting pin 526 in the manner described previously.

Figure 14:
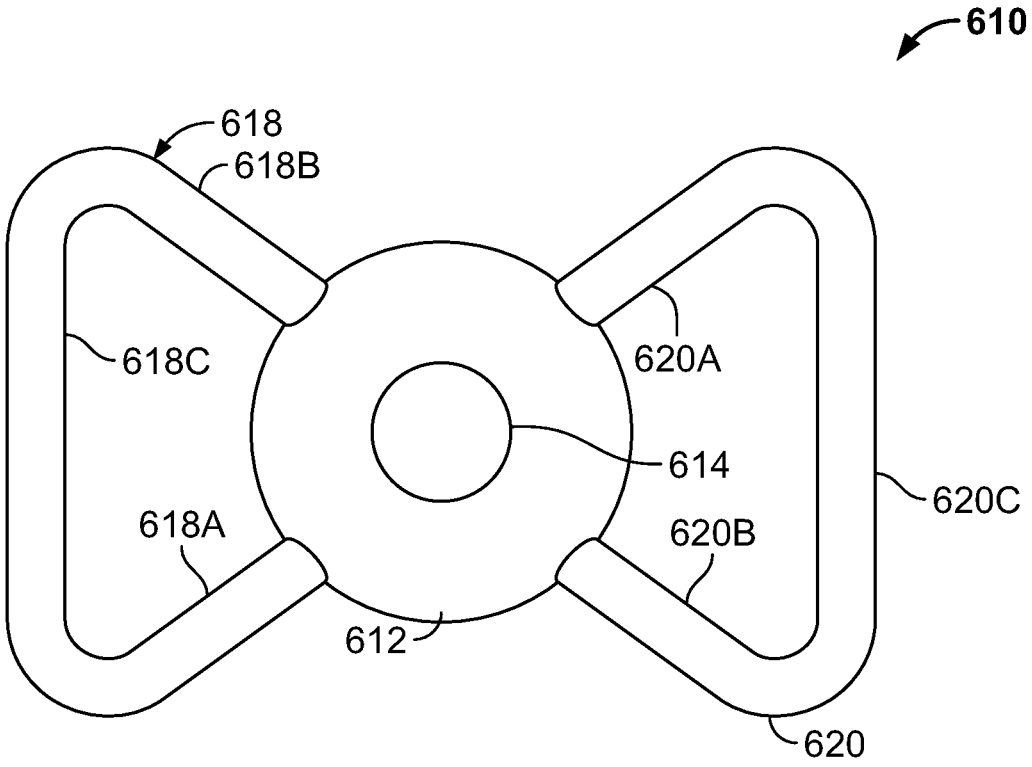
FIG. 14 is front view of an exercise weight that is an alternate to that of FIG. 3.
Figure 15:
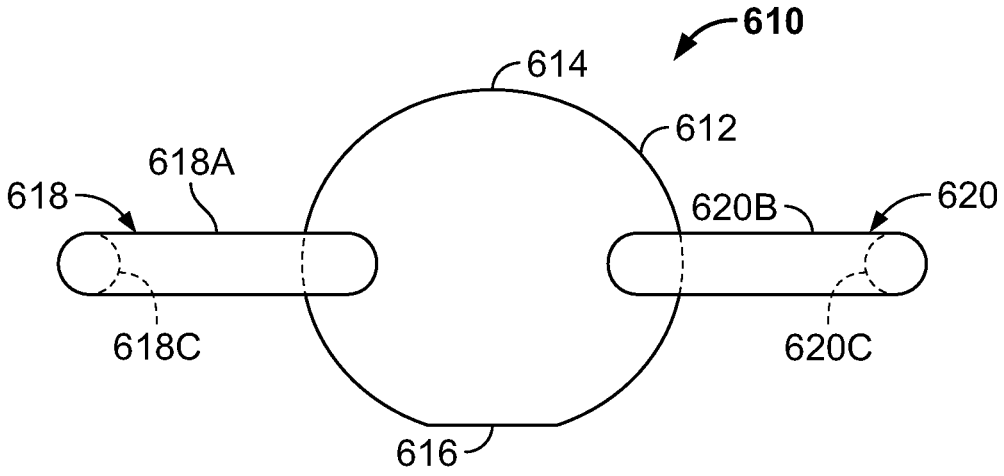
FIG. 15 side view of the exercise weight of FIG. 4.

Referring to FIGS. 14 and 15, an exercise weight 610 is shown that is similar to that shown in FIGS. 3 and 4. Components in FIGS. 14 and 15 corresponding to those in FIGS. 3 and 4 have the same reference numerals, but increased by 500.

Exercise weight 610 has weight member 612 that is mostly spherical but has only one flat surface 616. Thus, the polar opposite surface 614 is rounded.

Weight member 612 has on opposite sides handles 618 and 620. Handle number 618 (620) has a pair of connecting sections 618A and 618B (620A and 620B) that connect between weight member 612 and the opposite ends of outer section 618C (620C). Unlike the embodiment of FIGS. 3 and 4, outer sections 618C and 620C are straight.

The foregoing arrangement will be useful for performing pushups when the exerciser holds outer sections 618C and 620C while flat surface 616 rests on the floor. The other exercises previously described can also be performed with weight 610.

Referring to FIGS. 16-19, exercise weight 710 is similar to that illustrated in FIG. 15, and corresponding components have the same reference numerals but increased by 100. Again, weight member 712 has a pair of handles 718 and 720, and is mostly spherical except for flat circular section 716, which is parallel to the handles.

Mounted in a position diametrically opposite flat section 716 is ball bearing 738, which has ball 738A rotatably mounted in bearing cup 738B. Projecting from opposite sides of cup 738B are a pair of diametrically aligned, bayonet stubs 738C. Cup 738B is designed to slide into cylindrical cavity 742, which contains a helical compression spring 748 located between the floor of the cavity and the underside of circular disk 746.

Cavity 742 has an opposing pair of L-shaped, bayonet slots 744. Each of the stubs 738C can slide down to the bottom of the upright leg of a corresponding one of the slots 744 before turning to the right (clockwise rotation) and traveling through the lower leg of the slot.

The reverse side of cup 738B, opposite ball 738A, has a cruciform embossment 738D whose outside surface has a radius of curvature matching that of weight member 712.

Figure 16:
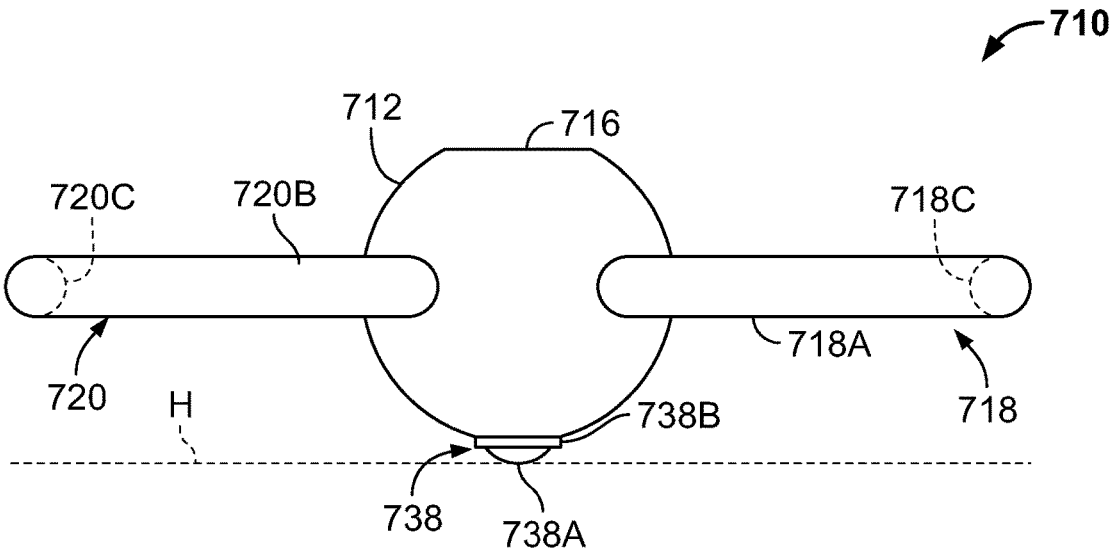
FIG. 16 is side view of an exercise weight that is an alternate to those previously mentioned.
Figure 17:
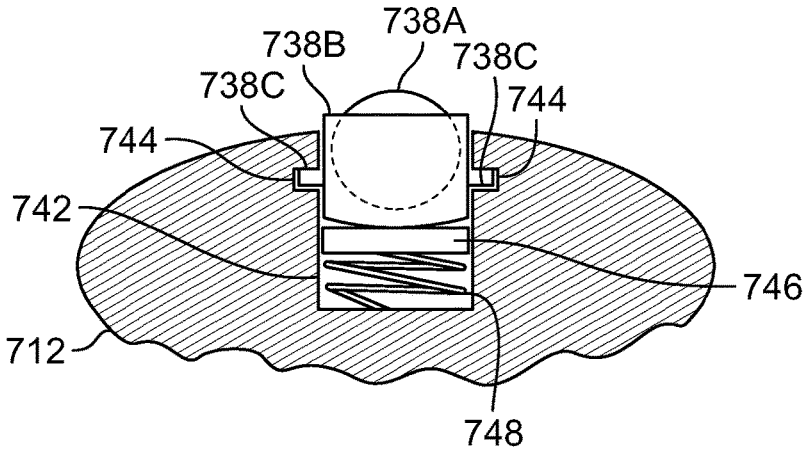
FIG. 17 is a detailed elevational view, partly in section, of the upper portion of the exercise weight of FIG. 16.
Figure 18:
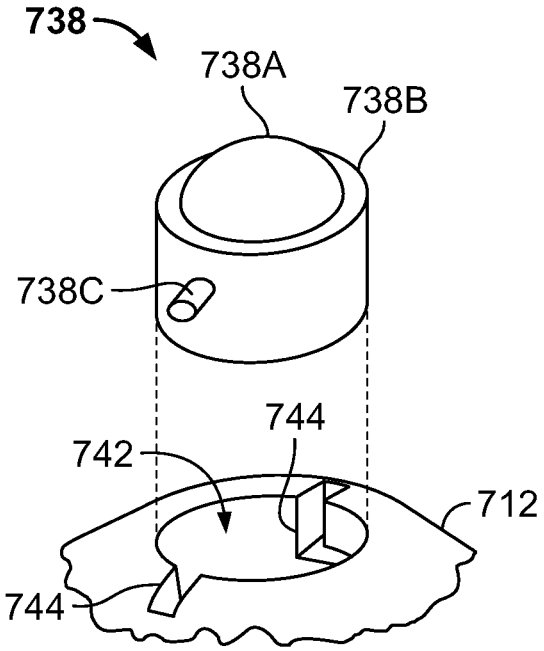
FIG. 18 is an exploded perspective view of the upper portion of the exercise weight of FIG. 16.
Figure 19:
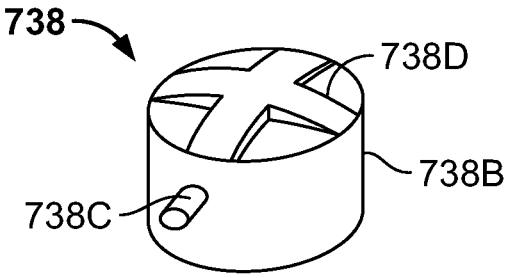
FIG. 19 is a perspective view of the insert of FIG. 18.

Exercise weight 710 can be used with bearing 738 installed in weight member 712 as shown in FIGS. 16 and 17. Exercise weight 710 can then be oriented as shown in FIG. 16 with ball 738A pressed down upon horizontal surface H (e.g., a gym floor). An exerciser can then grasp handle sections 718C and 720C and assume a plank position. The exerciser can maintain that position or perform pushups, as desired. Ball 738A is free to rotate inside bearing cup 738B. Accordingly, the exerciser will need to exert additional effort to not only keep handles 718 and 720 horizontal, but to keep weight member 712 from traveling across horizontal surface H.

Bearing 738 can be removed from weight member 712, as follows: The exerciser will depress bearing cup 738B and rotate it counterclockwise. This causes stubs 738C to travel through the lower leg of L-shaped bayonet slots 744, eventually reaching the slots' upright legs. Once in this position, spring 748 is able to upwardly urge disk 746, which in turn lifts bearing cup 738B.

The exerciser can then grasp and fully remove bearing 738. Bearing 738 can then be inverted and pressed downwardly into cylindrical cavity 742 with ball 738A facing down. Disk 746 will therefore descend and compress spring 748. Also, stubs 738C will be aligned with the upright legs of bayonet slots 744, and will travel down, eventually reaching the slots' lower legs. The exerciser will then rotate bearing cup 738B clockwise to move stubs 738C through the lower legs of bayonet slots 744. The exerciser will use the cruciform embossment 738D to grip and turn bearing cup 738B.

Once in position, embossment 738D will match the curvature of weight member 712. Thus, weight member 712 can be used as if its surface at and around bearing cup 738B was a simple uninterrupted spherical surface.

It is appreciated that various modifications may be implemented with respect to the above described embodiments. For example other embodiments may employ weights with different shapes, dimensions, proportions, and handle angles. In some embodiments the weight may be made of various materials such as plastics, ceramics, or composite materials. In some cases the weight member may be made of a different material than the handles. In some embodiments, the surface of the handles can be knurled or coated with an elastomeric material. Instead of a three-section handle (outer section and two connecting sections) one or more of these three sections can be divided into two or more subsections that extend at different angles. Also, any of the handle sections can be made straight or can be curved. Moreover, any of the sections previously shown as accommodating one hand can changed to accommodate two hands, or vice versa. In addition, the weight can be fitted with one or more straps for securing the weight to an ankle, wrist, waist, or other body part.

Obviously, many modifications and variations of the present invention are possible in light of the above teachings. It is therefore to be understood that within the scope of the appended claims, the invention may be practiced otherwise than as specifically described.

The invention claimed is:

1. An exercise weight, comprising:

a weight having a generally spherical body with truncated top and bottom sides; and two handles, each handle comprising:

an outer section spaced apart from the weight; and two connecting sections, each connecting section connected directly to the weight at one end and connected directly to opposing ends of the outer section at the other end, wherein the handles are attached to the generally spherical body at the left and right sides, relative to the truncated top and bottom, via the connecting sections, wherein the handles are linearly aligned and describe a transverse plane that is generally parallel with the truncated top and bottom sides;

wherein the truncated top and bottom sides of the weight provide a flattened surface to allow stacking of the weight with another similarly shaped weight.

2. The exercise weight according to claim 1, wherein the connecting sections of each handle are generally the same length and wherein each outer section is at least twice as long as the attached connecting sections.

3. The exercise weight according to claim 1, wherein the outer section of one handle is a double-handed grip and the attached connecting sections are each single-handed grips.

4. The exercise weight according to claim 1, wherein the generally spherical body is symmetrical about an axis perpendicular to the transverse plane.

5. The exercise weight according to claim 1, wherein the exercise weight is symmetrical about the transverse plane.

6. The exercise weight according to claim 1, wherein the connecting sections are attached to the generally spherical body at equidistant locations from one another.

7. The exercise weight according to claim 1, wherein at least two of the connecting sections are attached to the generally spherical body at locations that are diametrically opposed.

8. The exercise weight according to claim 1, wherein the connecting sections each have a straight longitudinal axis.

9. The exercise weight according to claim 1, wherein the handles are attached to the generally spherical body at locations separate from one another by at least 90° on the cross-section of the generally spherical body described by the transverse plane.

10. The exercise weight according to claim 1, wherein the angle described by each pair of connecting sections, attached to one of the outer sections, is less than 90°.

11. The exercise weight according to claim 8, wherein the longitudinal axis of one of the connecting sections of the right handle is parallel with the longitudinal axis of one of the connecting sections of the left handle.

12. The exercise weight according to claim 1, wherein each outer section has an arcuate centerline.

13. The exercise weight according to claim 1, further comprising:

a through hole; and a pin, wherein each of the connecting members of one of the handles is aligned with one of the connecting members of the other handle and meet outside of the generally spherical body of the weight, to establish a pair of interhandle junctures, and wherein the pin is removable and is adapted to slidably fit in the through hole and releasably attach to the pair of interhandle junctures in order to releasably suspend the generally spherical body between the interhandle junctures.

14. The exercise weight according to claim 1, comprising:

a ball bearing mounted on the weight projecting in a direction away from the transverse plane and adapted to roll across a horizontal surface with the pair of handles above the horizontal surface.

15. A set of differently sized exercise weights comprising:

a plurality of weights, each weight comprising:

a generally spherical body with truncated top and bottom sides; and two handles, each handle comprising:

an outer section spaced apart from the weight; and two connecting sections, each connecting section connected directly to the weight at one end and connected directly to opposing ends of the outer section at the other end, wherein the handles are attached to the generally spherical body at the left and right sides, relative to the truncated top and bottom, via the connecting sections, wherein the handles are linearly aligned and describe a transverse plane that is generally parallel with the truncated top and bottom sides;

wherein the truncated top and bottom sides of the weight provide a flattened surface to allow stacking of the weight with another weight of the set, and wherein one of the plurality of weights has a different size.

16. The set according to claim 15, wherein the outer section of one handle is a double-handed grip and the attached connecting sections are each single-handed grips.

17. The exercise set according to claim 15, wherein the generally spherical body is symmetrical about an axis perpendicular to the transverse plane.

18. The exercise set according to claim 15, wherein the exercise weight is symmetrical about the transverse plane.

* * * * *